US007703441B2

(12) United States Patent
Hathout et al.

(10) Patent No.: US 7,703,441 B2
(45) Date of Patent: Apr. 27, 2010

(54) METHOD AND DEVICE FOR ASCERTAINING A CYLINDER PRESSURE FEATURE

(75) Inventors: Jean-Pierre Hathout, Manisa (TR); Axel Loeffler, Backnang (DE); Wolfgang Fischer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/255,495

(22) Filed: Oct. 21, 2008

(65) Prior Publication Data

US 2009/0101110 A1 Apr. 23, 2009

(30) Foreign Application Priority Data

Oct. 22, 2007 (DE) ..... 10 2007 050 302

(51) Int. Cl.
*F02M 7/28* (2006.01)

(52) U.S. Cl. ..... 123/435; 123/436; 123/406.22; 123/406.41

(58) Field of Classification Search ..... 123/406.22, 123/406.41, 435–436, 406.42, 406.43; 73/35.07, 73/35.12, 114.16–114.18
See application file for complete search history.

(56) References Cited

U.S. PATENT DOCUMENTS

| | | | | |
|---|---|---|---|---|
| 6,854,441 | B2 * | 2/2005 | Vermonet et al. | 123/299 |
| 7,073,485 | B2 * | 7/2006 | Truscott et al. | 123/406.22 |
| 7,212,912 | B2 * | 5/2007 | Okubo et al. | 701/114 |
| 7,243,529 | B2 * | 7/2007 | Takemura et al. | 73/35.09 |
| 7,255,090 | B2 * | 8/2007 | Fader et al. | 123/435 |
| 7,543,484 | B2 * | 6/2009 | Kassner | 73/114.18 |
| 2009/0182491 | A1 * | 7/2009 | Bauer et al. | 701/115 |

* cited by examiner

*Primary Examiner*—Hai H Huynh
(74) *Attorney, Agent, or Firm*—Kenyon & Kenyon LLP

(57) ABSTRACT

A method for determining one or more cylinder pressure features for setting the combustion position in an internal combustion engine includes ascertaining a curve of a cylinder pressure or a curve of a cylinder pressure gradient with respect to a crankshaft angle, filtering the curve of the cylinder pressure or the curve of the cylinder pressure gradient using a filter, in order to eliminate a component of a pressure fluctuation brought about by the piston movement in the combustion chamber, and determining at least one cylinder pressure feature from the filtered curve.

16 Claims, 3 Drawing Sheets

METHOD AND DEVICE FOR ASCERTAINING A CYLINDER PRESSURE FEATURE

CROSS-REFERENCE TO RELATED APPLICATIONS

The present application claims priority to Application No. 10 2007 050 302.6, filed in the Federal Republic of Germany on Oct. 22, 2007, which is expressly incorporated herein in its entirety by reference thereto.

FIELD OF THE INVENTION

The present invention relates to a method and a device for ascertaining a cylinder pressure feature from the pressure curve recorded by a cylinder pressure sensor in a cylinder.

BACKGROUND INFORMATION

Engine control units up to now have been using a plurality of sensor values that are supplied by sensors to the internal combustion engine in order to control or regulate the injection system and the air system. This applies to both Otto and Diesel engines. One possible alternative of carrying out the engine control is to build up the engine control based on a direct combustion chamber signal that is individual to each cylinder, instead of the above-named sensor values, which supply only indirect data on the combustion process proceeding in the cylinders. For this purpose, it is proposed that one use cylinder pressure sensors to measure the cylinder pressure, since these have the greatest measuring accuracy. In the measurement of cylinder pressure, the basic reference variable, the average indicated pressure, represents a measure for the mechanical work performed by the engine. Since, in particular with Otto engines in SI operation (ignition operation), the average indicated pressure fluctuates very greatly from cycle to cycle, regulation based on this therefore has to be designed to be relatively slow. For this reason, a second control system is integrated based on the combustion position for rapid efficiency adaptation.

In this connection, the angle of the maximum cylinder pressure $\phi(p_max)$ brought about by the combustion process has turned out to be a further advantageous reference variable, or the angle of the maximum cylinder pressure gradient over the combustion position $\phi(dp_max/d\phi)$. However, both signals are superposed by the compression curve, that is, by the component of the pressure that is caused by the compression and expansion based on the piston movement in the cylinder. In this context, there exists fundamentally the problem that this feature is difficult to extract if the maximum pressure value is no longer caused by the compression in the cylinder, as is the case, for example, in response to very late combustion positions.

In the potential use of a cylinder pressure-based engine control, particular importance should be placed on combustion position regulation both for the Otto engine, for example, for determining efficiency during conventional SI operation, in controlled self-ignition, and in the stabilization of new combustion methods for fuel reduction, as well as for the Diesel engine, as, for example, for stabilizing new combustion methods for emission reduction.

Up to now, the combustion position features have been ascertained from the pressure curve, by calculating the compression curve with the aid of a so-called heating curve calculation, in order to obtain the cylinder pressure brought about only by the combustion as an output variable for the determination of the cylinder pressure features required. The heating curve calculation is based on the converted energy quantity, from which the work expended during the compression may be ascertained, so that one may conclude what the pressure is that is acting in the cylinder because of the compression. However, implementing such a calculation requires a lot of effort.

SUMMARY

Example embodiments of the present invention extract combustion position features based on a cylinder pressure feature in a simple manner, without requiring a costly calculation of the pressure curve brought about by the compression and expansion.

According to example embodiments of the present invention, a method is provided for determining one or more cylinder pressure features for setting the combustion position in an internal combustion engine. The method includes: ascertaining a curve of a cylinder pressure or a curve of a cylinder pressure gradient with respect to a crankshaft angle; filtering the curve of the cylinder pressure or the curve of the cylinder pressure gradient using a high pass filter, in order to eliminate a component of a pressure fluctuation brought about by the movement of the piston in the combustion chamber; and determining at least one cylinder pressure feature from the filtered curve.

The above method makes it possible to obtain features individual to each cylinder on the combustion position directly, and without a costly calculation of a compression curve, for example, with the aid of a heating curve calculation, etc., from the curve of the cylinder pressure or from the curve of the cylinder pressure gradient, in a simple and robust manner. This is achieved in that the influence of the compression and expansion process in the combustion chamber based on the piston motion is suppressed by filtering out the pressure curve brought about thereby in the cylinder.

Furthermore, one may determine as at least one cylinder pressure feature the position of the maximum of the filtered curve of the cylinder pressure or the curve of the cylinder pressure gradient and/or the magnitude of the amplitude of the filtered curve of the cylinder pressure or the curve of the cylinder pressure gradient at its maximum and/or a crankshaft angle difference between the crankshaft angle of the first local minimum before the maximum cylinder pressure or the maximum cylinder pressure gradient and the first local minimum after the maximum cylinder pressure or the maximum cylinder pressure gradient.

According to example embodiments, the filtering of the curve of the cylinder pressure or the curve of the cylinder pressure gradient may be performed using a high pass filter, especially using a high pass filter whose boundary frequency is variable and is a function of the current rotational speed of the internal combustion engine, the filtering being carried out particularly in a phase-compensated manner.

It may be provided that the curve of the cylinder pressure or the curve of the cylinder pressure gradient are low pass filtered using a low pass filter and/or are submitted to an offset correction.

Furthermore, the high pass filtering and the low pass filtering may be performed by a band pass filtering.

According to example embodiments, an engine control unit is provided for determining one or more cylinder pressure features for setting the combustion position in an internal combustion engine. The engine control unit is arranged to ascertain a curve of a cylinder pressure or a curve of a cylinder pressure gradient with respect to a crankshaft angle, in order to filter the curve of the cylinder pressure or the curve of the cylinder pressure gradient using a high pass filter, in order to eliminate a component of a pressure fluctuation brought about by the piston movement in the combustion chamber, and in order to determine the at least one cylinder pressure feature from the filtered curve.

According to example embodiments, an engine system is provided having an internal combustion engine that has the above engine control unit and having a pressure sensor, situated in at least one cylinder of the internal combustion engine, for recording the cylinder pressure.

According to example embodiments, a computer program is provided which includes a program code, and, if it is executed on a data processing unit, it executes the above method.

Example embodiments of the present invention are explained in greater detail in the following text with reference to the appended Figures.

DETAILED DESCRIPTION

Figure 1:
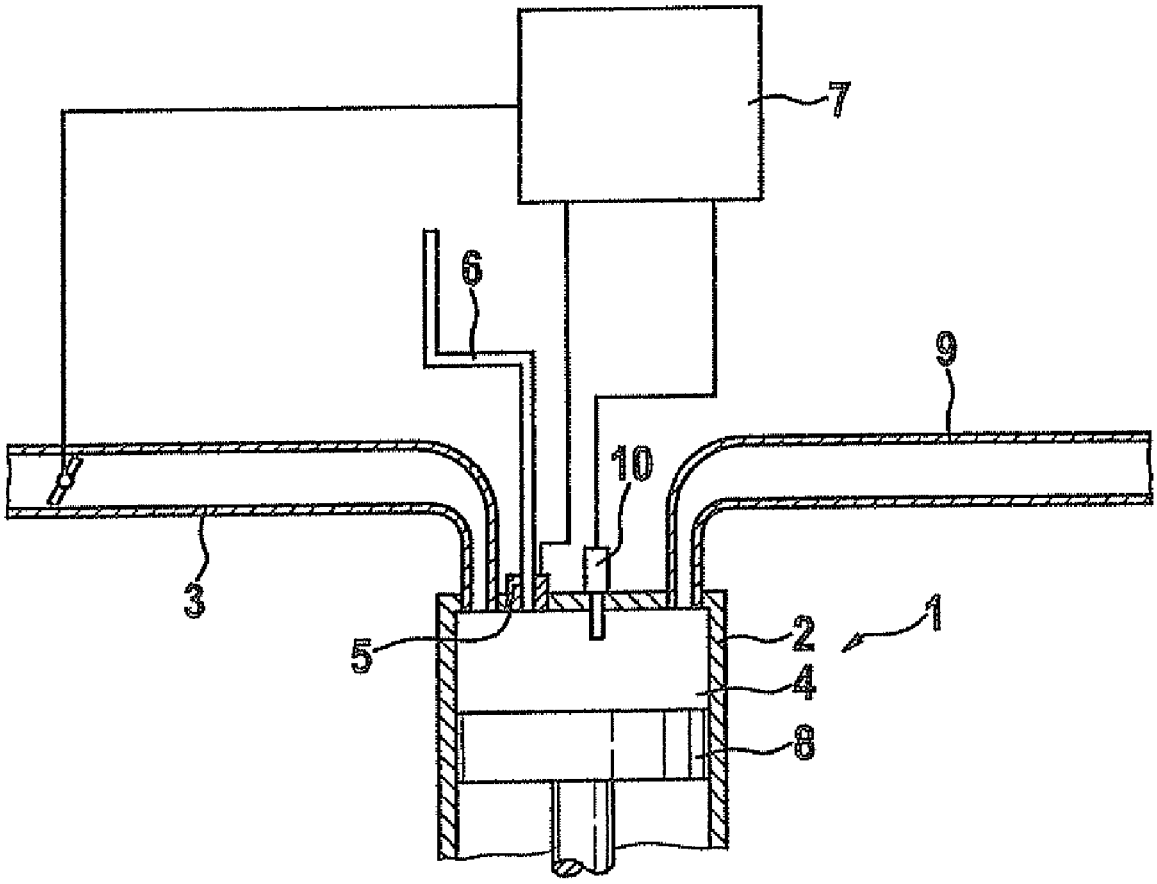
FIG. 1 is a schematic view of a cylinder of a Diesel engine system which is able to be used to carry out the method according to example embodiments of the present invention.

FIG. 1 shows as an example embodiment an engine system having an internal combustion engine 1 that has a cylinder 2 shown in exemplary fashion. As an example shown, internal combustion engine 1 is shown as a Diesel engine in which the fuel is injected directly into the combustion chamber. However, the present method may be transferred without a problem to Otto engines or to internal combustion engines not having direct injection, as is the case, for example, in the injection of fuel into the intake manifold.

In the engine system shown in FIG. 1, air is supplied into a combustion chamber 4 of cylinder 2 via an intake manifold 3. Fuel is injected via a fuel injector 5 from a fuel line 6 into combustion chamber 4, controlled by an engine control unit 7. During operation of internal combustion engine 1, piston 8, which moves in combustion chamber 4, brings about a compression which heats the fuel/air mixture located in combustion chamber 4, so that thereby a self-ignition and a combustion process are triggered driving piston 8. The piston is moved thereby and combustion chamber 4 is enlarged, whereby the gas in combustion chamber 4 expands. After the combustion, the combustion exhaust gases are exhausted from combustion chamber 4, with the aid of a further piston movement, via an exhaust gas section 9.

For the engine control it is provided to have a pressure sensor 10 situated on combustion chamber 4, which measures the cylinder pressure in the combustion chamber continuously, either at established time intervals or as a function of a crankshaft angle, for instance, at intervals of 0.5°, and makes available the resulting cylinder pressure signal to engine control unit 7. Engine control unit 7 evaluates the cylinder pressure signal and controls internal combustion engine 1 correspondingly, as a function of the cylinder pressure signal. In particular, engine control unit 7 regulates or controls the throttle valve position and the injection quantity, as well as the point of injection of the internal combustion engine, as a function of the cylinder pressure signal.

From the curve of the cylinder pressure signal of pressure sensor 10, one or more of the following cylinder pressure features are extracted:

1. The amplitude of cylinder pressure p may be determined at crankshaft angle $\phi$, at which cylinder pressure is a maximum. Alternatively or in addition, the amplitude of cylinder pressure gradient dp may be determined at crankshaft angle $\alpha$, at which cylinder pressure gradient dp is a maximum. This maximum cylinder pressure p_max or cylinder pressure gradient dp_max varies depending on the combustion position with respect to crankshaft angle $\phi$, and permits a statement to be made via the noise development during combustion.

2. The position of the maximum cylinder pressure, that is, the crankshaft angle $\phi$ at which the maximum pressure value p_max, or the maximum cylinder pressure gradient dp_max occurs, is relevant for the emission of the combustion and the efficiency of the engine.

3. As a further important measuring variable, the duration of combustion is determined, which is given as the crankshaft angle difference. The duration of combustion then corresponds to a crankshaft angle difference between the first local minimum before maximum pressure value p_max or the maximum gradient of pressure value dp_max and the first local minimum after the maximum pressure value dp_max. The duration of the combustion is able to be derived from the crankshaft angle difference. One may, for example, derive assumptions concerning the fuel composition from the duration of the combustion.

All or a part of the above-named cylinder pressure features are used in engine control unit 7, either directly for controlling internal combustion engine 1 or for diagnosing the functioning of internal combustion engine 1.

Figure 2:
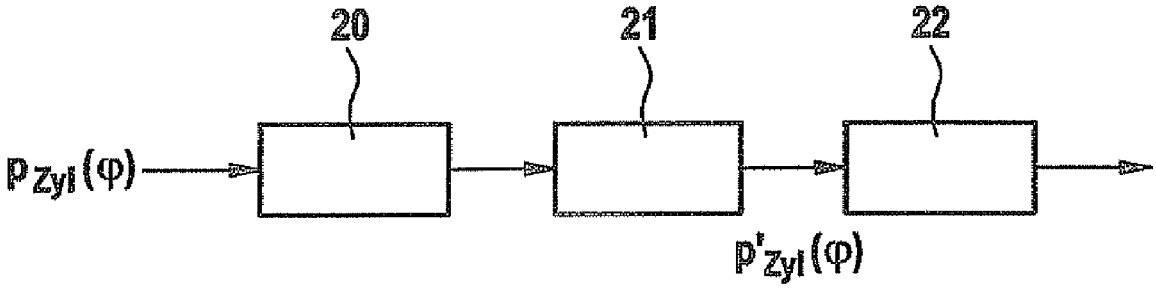
FIG. 2 is a block diagram to illustrate the function of the method for providing simple and robust cylinder pressure features.

FIG. 2 shows a schematic representation of the functions executed in engine control unit 7. The point of departure for the method is the measuring variable cylinder pressure $p_{cyl}$, which is recorded in an angularly synchronous manner and first of all smoothed, using a low pass filter 20. Subsequently, an offset correction is carried out in an offset correction element 21. The curve $p_{cyl}(\phi)$ is evaluated directly for the position of the maximum $\phi$(p_max) or differentiated with respect to the crankshaft angle, in order to obtain the signal curve of cylinder pressure gradient $dp_{cyl}(\phi)/d\phi$. From the signal curve of the cylinder pressure gradient one is able to ascertain the crankshaft angle $\phi$ of its maximum $dp_{max}$.

Figure 3:
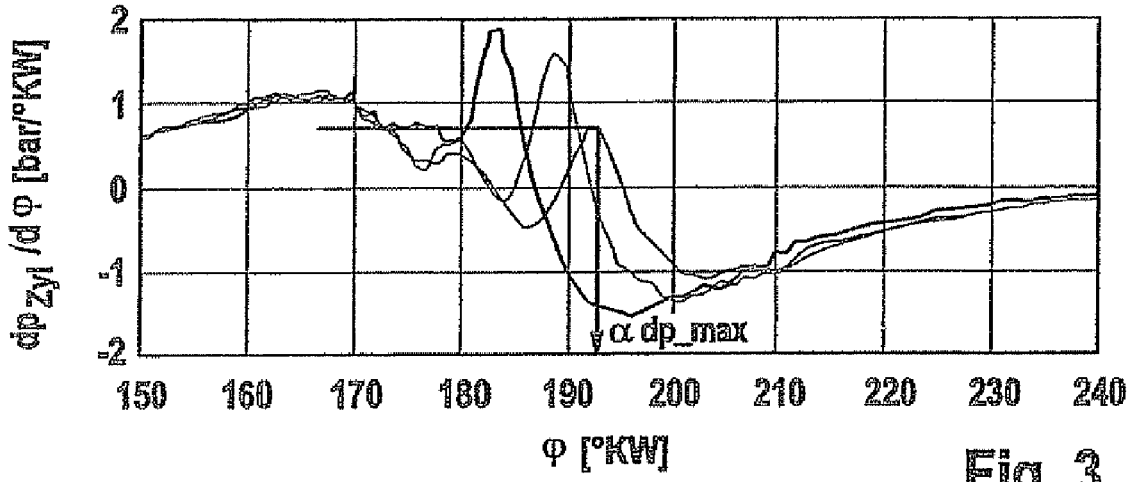
FIG. 3 is a diagram for showing the curve of the cylinder pressure gradient plotted against the crankshaft position, having a superposed compression curve in response to three working cycles having different ignition angles.
Figure 4:
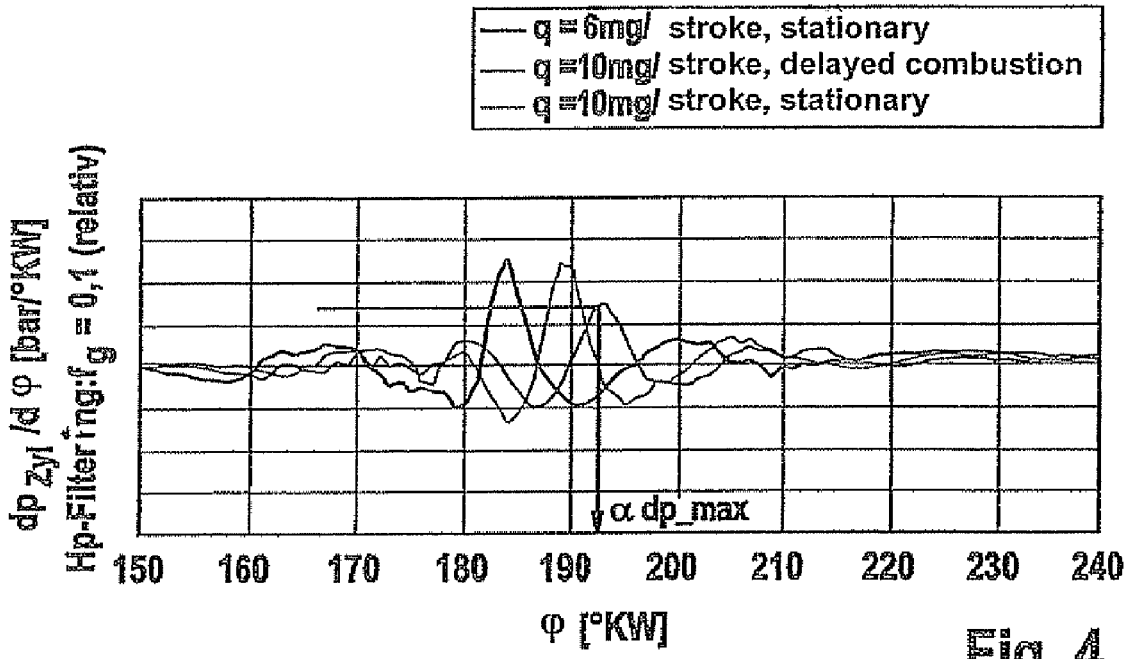
FIG. 4 is a diagram for showing the curve of the cylinder pressure gradient in response to the use of a high pass filtration in the three working cycles having the different ignition angles shown in FIG. 3.

FIGS. 3 and 4 show cylinder pressure gradients for three working cycles in response to an abrupt change in load in pHCCI operation (pHCCI: partially homogeneous charge compression ignition).

FIG. 3 shows three curves of the cylinder pressure gradient at various combustion positions in the three successive working cycles, no measures for eliminating the compression having been undertaken. However, onto the actually interesting combustion component in these curves, as may be seen in FIG. 3, the slow component, but provided with a relatively large amplitude, of compression and expansion is superposed, that is a compression curve. The superposition of the compression curve has the effect that the maximum, associated with the combustion, of cylinder pressure curve $p_{cyl}(\phi)$ or cylinder pressure gradient curve $dp_{cyl}(\phi)/d\phi$, especially in the case of late, potentially delayed combustions, has no global but only still a local character. The robust determination of this maximum, which in this case is only still a local maximum, can accordingly not be reliably carried out, or is able to be ascertained only using an increased calculating effort.

For this reason, a high pass element 22 is provided, in order to eliminate the compression and expansion components, that is, the compression curve. This is possible, since the compression curve has a known frequency response that is a function of the rotational speed of the internal combustion engine. By the use of high pass filter element 22, one obtains a signal curve of the cylinder pressure or the curve of the cylinder pressure gradient, as is shown in FIG. 4. In FIG. 4, three curves of the cylinder pressure gradient are shown, for the same combustion positions as in FIG. 3. One may see that, in the three different combustion positions shown, in comparison to the diagram in FIG. 3, even at the crankshaft angle at a very late combustion, the maximum of the cylinder pressure or its gradient are still able to be determined without a problem.

Since the cylinder pressure recording as a rule takes place in an angularly synchronous manner, the high pass filtering of the high pass filter element has to be laid out relative to the scanning frequency, so that the compression and expansion components of the pressure signal or its gradients are securely suppressed. The actual boundary frequency of high pass filter element 22 is then a function of the rotational speed. Cylinder pressure p may be filtered in a phase-compensated manner.

According to example embodiments, the low pass filtering in low pass filter element 20 and the high pass filtering in high pass filter element 22 may be undertaken within a single signal processing step, using an appropriate band pass filter.

If, alternatively to the above-described example embodiment, the cylinder pressure signal is recorded time-synchronously, the boundary frequency of high pass filter element 22 must be established as a function of the rotational speed. If, however, for resource reasons, one interprets it as having a fixed value independent of the rotational speed, the boundary frequency may be selected such that it securely suppresses the compression and expansion components of the signal for the highest occurring rotational speed.

What is claimed is:

1. A method for determining at least one cylinder pressure feature for setting a combustion position in an internal combustion engine, comprising:

ascertaining at least one of (a) a curve of a cylinder pressure and (b) a curve of a cylinder pressure gradient with respect to a crankshaft angle;

filtering the at least one of (a) the curve of the cylinder pressure and (b) the curve of the cylinder pressure gradient, using a filter, in order to eliminate a component of a pressure fluctuation brought about by a piston movement in the combustion chamber; and determining at least one cylinder pressure feature from the filtered curve.

2. The method according to claim 1, wherein, as at least one cylinder pressure feature, a position is determined of at least one of(a) a maximum of the filtered curve, (b) a magnitude of an amplitude of the filtered curve at a maximum, (c) a crankshaft angle difference between one of (i) a crankshaft angle of a first local minimum before a maximum cylinder pressure and (ii) a maximum cylinder pressure gradient and one of (i) a first local minimum after the maximum cylinder pressure and (ii) the maximum cylinder pressure gradient.

3. The method according to claim 1, wherein the filtering is carried out using a high pass filter.

4. The method according to claim 3, wherein the filtering is carried out using a high pass filter whose boundary frequency is variable and is a function of a current rotational speed of the internal combustion engine, and the filtering is carried out in a phase-compensated manner.

5. The method according to claim 3, further comprising:

determining a duration of combustion, wherein the duration of combustion is derived from a crankshaft angle difference, and wherein the filtering eliminates compression and expansion components.

6. The method according to claim 1, wherein the curve is at least one of (a) low pass filtered using a low pass filter and (b) submitted to an offset correction.

7. The method according to claim 6, wherein a high pass filtering and the low pass filtering is performed by a band pass filtering.

8. The method according to claim 1, further comprising:

determining a duration of combustion, wherein the duration of combustion is derived from a crankshaft angle difference.

9. The method according to claim 1, wherein:

as at least one cylinder pressure feature, a position is determined of at least one of (a) a maximum of the filtered curve, (b) a magnitude of an amplitude of the filtered curve at a maximum, (c) a crankshaft angle difference between one of (i) a crankshaft angle of a first local minimum before a maximum cylinder pressure and (ii) a maximum cylinder pressure gradient and one of (i) a first local minimum after the maximum cylinder pressure and (ii) the maximum cylinder pressure gradient, the filtering is carried out using a high pass filter using a high pass filter whose boundary frequency is variable and is a function of a current rotational speed of the internal combustion engine, and the filtering is carried out in a phase-compensated manner, the curve is at least one of (a) low pass filtered using a low pass filter and (b) submitted to an offset correction, and a high pass filtering and the low pass filtering is performed by a band pass filtering.

10. The method according to claim 9, further comprising:

determining a duration of combustion;

wherein the duration of combustion is derived from a crankshaft angle difference, and wherein the filtering eliminates compression and expansion components.

11. A device, comprising:

an engine control unit, including:

a pressure determining arrangement configured to determine at least one cylinder pressure feature for setting a combustion position in an internal combustion engine;

a pressure curve ascertaining arrangement configured to ascertain at least one of (a) a curve of a cylinder pressure and (b) a curve of a cylinder pressure gradient with respect to a crankshaft angle;

a filtering arrangement configured to filter the curve using a high pass filter, in order to eliminate a component of a pressure fluctuation brought about by a piston movement in a combustion chamber; and a cylinder pressure feature determining arrangement configured to determine at least one cylinder pressure feature from the filtered curve.

12. The device according to claim 11, wherein the engine control unit regulates or controls a throttle valve position, an injection quantity, and a point of injection of the internal combustion engine, as a function of the cylinder pressure feature.

13. The device according to claim 11, wherein:

as at least one cylinder pressure feature, a position is determined of at least one of (a) a maximum of the filtered curve, (b) a magnitude of an amplitude of the filtered curve at a maximum, (c) a crankshaft angle difference between one of (i) a crankshaft angle of a first local minimum before a maximum cylinder pressure and (ii) a maximum cylinder pressure gradient and one of (i) a first local minimum after the maximum cylinder pressure and (ii) the maximum cylinder pressure gradient, the filtering is carried out using a high pass filter using a high pass filter whose boundary frequency is variable and is a function of a current rotational speed of the internal combustion engine, and the filtering is carried out in a phase-compensated manner, the curve is at least one of (a) low pass filtered using a low pass filter and (b) submitted to an offset correction, and a high pass filtering and the low pass filtering is performed by a band pass filtering.

14. An engine system, comprising:

an internal combustion engine;

a pressure sensor arranged in at least one cylinder of the internal combustion engine configured to record cylinder pressure; and an engine control unit, including:

a pressure determining arrangement configured to determine at least one cylinder pressure feature for setting a combustion position in an internal combustion engine;

a pressure curve ascertaining arrangement configured to ascertain at least one of (a) a curve of a cylinder pressure and (b) a curve of a cylinder pressure gradient with respect to a crankshaft angle;

a filtering arrangement configured to filter the curve using a high pass filter, in order to eliminate a component of a pressure fluctuation brought about by a piston movement in a combustion charnber; and a cylinder pressure feature determining arrangement configured to determine at least one cylinder pressure feature from the filtered curve.

15. The engine system according to claim 14, wherein the engine control unit regulates or controls a throttle valve position, an injection quantity, and a point of injection of the internal combustion engine, as a function of the cylinder pressure feature.

16. The engine system according to claim 14, wherein:

as at least one cylinder pressure feature, a position is determined of at least one of (a) a maximum of the filtered curve, (b) a magnitude of an amplitude of the filtered curve at a maximum, (c) a crankshaft angle difference between one of (i) a crankshaft angle of a first local minimum before a maximum cylinder pressure and (ii) a maximum cylinder pressure gradient and one of (i) a first local minimum after the maximum cylinder pressure and (ii) the maximum cylinder pressure gradient, the filtering is carried out using a high pass filter using a high pass filter whose boundary frequency is variable and is a function of a current rotational speed of the internal combustion engine, and the filtering is carried out in a phase-compensated manner, the curve is at least one of(a) low pass filtered using a low pass filter and (b) submitted to an offset correction, and a high pass filtering and the low pass filtering is performed by a band pass filtering.

* * * * *